United States Patent [19]

Stritzl et al.

[11] Patent Number: 4,955,633

[45] Date of Patent: Sep. 11, 1990

[54] ADJUSTING DEVICE FOR A SKI BINDING

[75] Inventors: Karl Stritzl; Henry Freisinger, both of Vienna; Hubert Würthner, Hainburg/Donau; Andreas Riegler, Vienna, all of Austria

[73] Assignee: TMC Corporation, Switzerland

[21] Appl. No.: 251,647

[22] PCT Filed: Oct. 8, 1987

[86] PCT No.: PCT/EP87/00587

§ 371 Date: Jun. 10, 1988

§ 102(e) Date: Jun. 10, 1988

[87] PCT Pub. No.: WO88/04562

PCT Pub. Date: Jun. 30, 1988

[30] Foreign Application Priority Data

Dec. 18, 1986 [AT] Austria ..... 3363/86

[51] Int. Cl.[5] ..... A63C 9/00

[52] U.S. Cl. ..... 280/633; 280/618

[58] Field of Search ..... 280/633, 636, 617, 628, 280/618

[56] References Cited

U.S. PATENT DOCUMENTS

| | | | |
|---|---|---|---|
| 3,950,001 | 4/1976 | Weigl | 280/633 |
| 4,817,981 | 4/1989 | Desbiolles et al. | 280/633 |

FOREIGN PATENT DOCUMENTS

| | | | |
|---|---|---|---|
| 338674 | 9/1977 | Austria . | |
| 368394 | 10/1982 | Austria | 280/633 |
| 375260 | 7/1984 | Austria . | |
| 1954512 | 5/1970 | Fed. Rep. of Germany | 280/633 |
| 1910060 | 9/1970 | Fed. Rep. of Germany | 280/633 |
| 2541471 | 6/1976 | Fed. Rep. of Germany | 280/633 |
| 3150098 | 7/1982 | Fed. Rep. of Germany | 280/633 |
| 3150099 | 7/1982 | Fed. Rep. of Germany | 280/633 |

*Primary Examiner*—David M. Mitchell

*Attorney, Agent, or Firm*—Finnegan, Henderson, Farabow, Garrett & Dunner

[57] ABSTRACT

An adjustment device for a ski binding comprises a slide mounted on a ski, where the slide includes a plurality of legs and a base. A locking member, which has a plurality of teeth, is pivotably mounted on the base on a pivot axis. A guide plate which has a plurality of prongs and a strip including a plurality of teeth guides the slide. An adjustment mechanism adjusts the slide relative to the guide plate. The adjustment means is actuated for bringing the teeth of the locking member into engagement with the teeth of the strip and for bringing one of the prongs of the guide plate into frictional engagement with one of the legs of the slide.

8 Claims, 3 Drawing Sheets

ADJUSTING DEVICE FOR A SKI BINDING

BACKGROUND OF THE INVENTION

1. Field of the Invention

The invention relates to an adjusting device for a ski binding.

2. Description of the Prior Art

An adjusting device for a ski binding is described in German Offenlegungsschrift No. 1,954,512. In this adjusting device, an adjusting member is designed as a pusher which is displaceable transversely relative to the longitudinal direction of the ski and which can be locked by means of a spring. The pusher is provided with a recess into which an extension of a locking member designed as a two-armed lever is fitted.

The disadvantage of this adjusting device is that, because of the teeth which are triangular as seen in plan view, during operation the locking member is subjected to a torque which tends to disengage the teeth of the locking member from the teeth of the toothed strip. As a result of this torque, however, the surface pressure between the extension of the locking member, located on the shorter lever arm, and the recess in the pusher, into which the extension engages, becomes so great that, after the adjusting device has been in use for a long time, deformations can occur, resulting in an unintentional release of the locking member and the toothed strip.

Another adjusting device is described in Austrian Patent Specification No. 375,260. This adjusting device has a frame-shaped guide plate which is equipped with angled guides disposed in the region of its edges and extending in the longitudinal direction. However, it is impossible for the guide plate to be bent and consequently pressed against the slide by the locking member, even in this arrangement, where the locking member is designed as a one-armed lever. This patent specification discloses only a positive connection between the slide and the base plate of the ski and using a cam as an adjusting device of a ski binding. Using an eccentric as an adjusting member is disclosed in Austrian Patent Specification No. 338,674.

The concept, in an adjusting device for a ski binding, of retaining the slide not only as a result of a positive connection, but also as a result of friction, is already known per se, as shown by French Patent Specification No. 2,578,434. In the embodiment described therein a guide plate fastened to a ski is formed with a substantively U-shaped cross-section, and a row of holes is made in one leg of the U. Mounted displaceably on this guide plate is a slide which, in one of its end regions, carriers locking teeth adapted to be engaged with the row of holes. The slide can be pivoted within the guide plate until the locking teeth can be disengaged from the row of holes.

However, to prevent the adjusting device from being released unintentionally, mounted rotatably in a recess of the slide, on an axle perpendicular to the top side of the ski, is a two-armed lever, the longer arm of which is supported, in the locked position of the adjusting device, on that leg of the guide plate which does not have holes. The shorter arm of the lever rests against an adjusting member which fixes the lever either in a position in which the longer arm projects laterally beyond the slide, or else in a position in which this arm is in line with the side face of the slide.

The disadvantage of this design is that it has a complicated construction, since to obtain the desired effect (locking of the lever in two positions) either the axle of the lever or the axle of the adjusting member has to be mounted in an elastomeric intermediate sleeve. The lever is therefore biased by a spring, which sets limits on the force and which thereby reduces the friction. This is all the more so because the pressing force is reduced at the point of application as a result of the lever reduction.

SUMMARY OF THE INVENTION

The object of the invention is to eliminate the disadvantages of known designs and provide an adjustment device for a ski binding in which the locking of the slide is brought about not only as a result of a positive connection, but at the same time also as a result of a non-positive connection.

Additional objects and advantages of the invention will be set forth in part in the description which follows, and in part will be obvious from the descriptions, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an adjusting device for a ski binding comprising a slide mounted on the ski, the slide including a plurality of legs and a base extending between the legs; at least one locking member pivotably mounted on the base on a pivot axis, the locking member including a plurality of teeth; a guide plate for guiding the slide, the guide plate extending in a longitudinal direction of the ski and comprising a plurality of prongs and at least one strip including a plurality of teeth and adjustment means for actuating the slide relative to the guide plate the adjustment means adapted to be actuated for bringing the teeth of the locking member into engagement with the teeth of the strip and for bringing one of the prongs of the guide plate into frictional engagement with one of the legs of the slide.

BRIEF DESCRIPTIONS OF THE DRAWINGS

DESCRIPTION OF THE PREFERRED EMBODIMENTS

Reference will now be made in detail to the present preferred embodiments of the invention examples of which are illustrated in the accompanying drawings.

Figure 1:
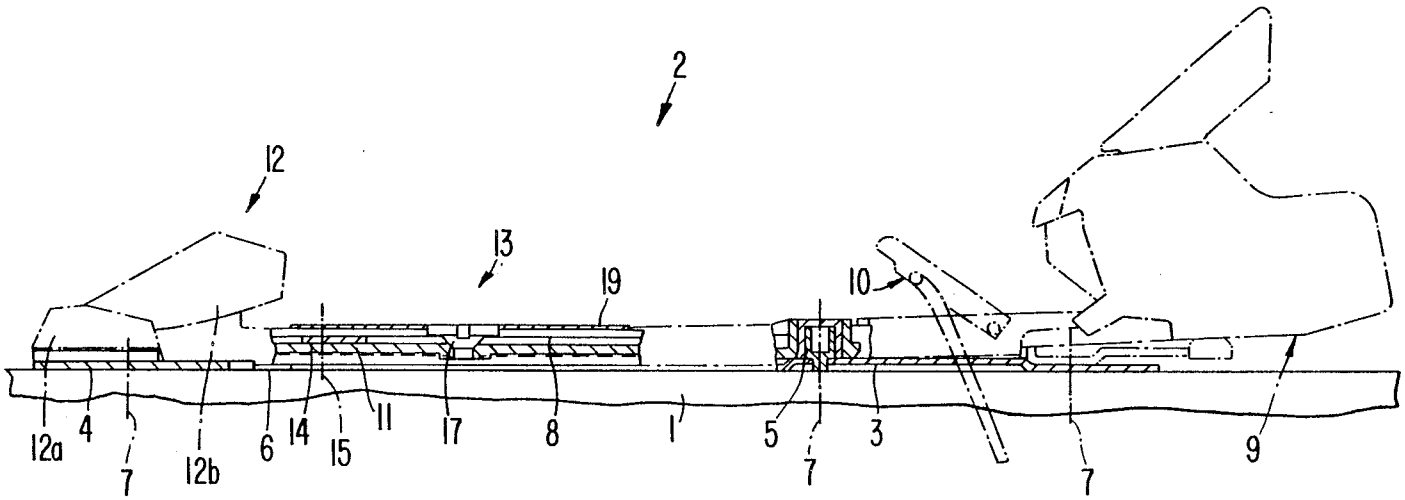
FIG. 1 is a partial sectional side view of a ski binding equipped with an adjusting device according to the present invention.
Figure 2:
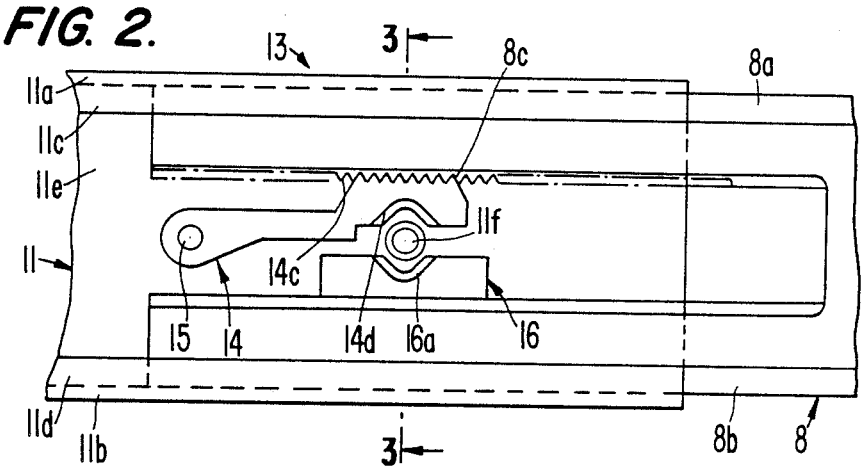
FIG. 2 is a plan view of a first embodiment of the adjusting device according to the present invention, with the cover and adjusting screw removed, in the locked state.

In FIG. 1, 1 denotes a ski, to which is fastened a ski binding shown generally by 2. This ski binding 2 has an assembly plate 3 in its rear region and a base plate 4 in its front region. The two plates 3 and 4 are screwed to the top of the ski 1 by means of a plurality of screws 7. At the same time, attached to the assembly plate 3 is a pivot 5 serving as the pivotable mounting of a guide plate 8. The latter carries, at its rear end, a heel holder 9. A ski brake 10 is arranged in the guide plate 8. Guided at the front end of the guide plate 8 is a slide 11 which, at its front end, carries a sole holder 12*b* of two-part front jaw 12. The front part of the front jaw 12 is designed as a guide block 12*a* for the sole holder 12*b* and is guided on the base plate 4 so as to be longitudinally displaceable. The slide 11, at its front end, carries a sliding plate 6 on its underside.

The design of the front jaw 12 and of the heel holder 9 does not in itself from any subject of the invention. Consequently, the special design of these binding parts is not discussed. The slide 11 can be adjusted relative to the guide plate 8 by means of an adjusting device forming the subject of the invention, as illustrated in FIGS. 2 to 5.

According to FIGS. 2 to 5, the guide plate 8 has a fork-shaped configuration including a plurality of fork prongs 8*a*, 8*b*. At least one of the fork prongs 8*a*, 8*b* is equipped with a toothed strip 8*c*. The slide 11 guided on the guide plate 8 in the longitudinal direction of the ski is, in cross-section, substantially U-shaped and opens inwardly. The slide 11 comprises a plurality of legs 11*a* and 11*b* and a base 11*e*. The legs 11*a* and 11*b* of the slide 11 carry a plurality of inwardly directed flanges 11*c* and 11*d*. At the base 11*e* of the slide 11, a locking member 14 equipped with locking teeth 14*c* is mounted pivotably on pivot axis 15. Located on the top side of the base 11*e* is a supporting plate 16 which is located opposite that end of the locking member 14 carrying the locking teeth 14*c* and which is freely movable.

In the longitudinal mid-plane of the adjusting device 13, in the region between the supporting plate 16 and that end of the locking member 14 carrying the locking teeth 14*c*, cut out in the base 11*e* of the slide 11 is a threaded bore 11*f* into which an adjusting screw 17 forming the adjusting member is screwed. The adjusting screw 17 has, adjoining the screw head 17*a*, a cone 17*b* joined to the threaded portion 17*c* of the adjusting screw. On sides facing the adjusting screw 17, the locking member 14 and the supporting plate 16 carry recesses 14*d* and 16*a* which are V-shaped, as seen in plan view, and which are chamfered at their upper edge. When the adjusting device 13 is in the released state, the distance between the supporting plate 16 and that side of the locking member 14 located opposite locking teeth 14*c* is less than the diameter of the adjusting screw 17. Although the supporting plate 16 is freely movable relative to the base 11*e* of the slide 11, it therefore can be lost when the adjusting device 13 is released.

Plates 18*a* and 18*b* made of low-friction plastic are attached to the guide plate 8. The slide 11 is covered, at least in the region of the adjusting device 13, by a cover 19 of U-shaped cross-section, in order to prevent snow and dirt from penetrating. This cover 19, in its middle region, has a recess 19*a* which allows the passage of the adjusting screw 17.

Figure 4:
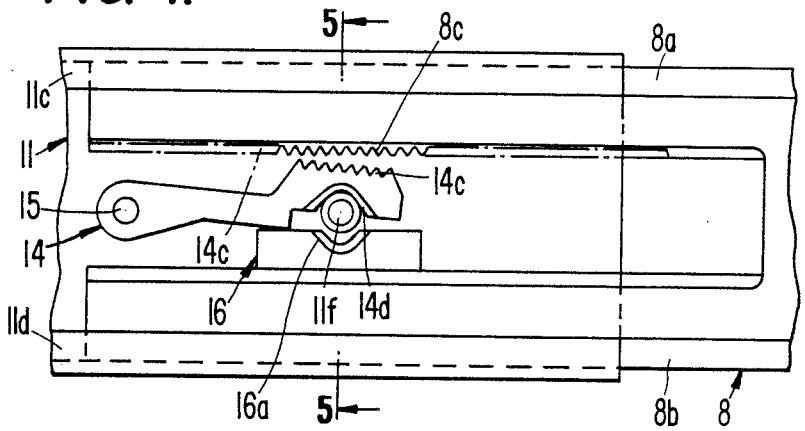
FIG. 4 is a plan view of the adjusting device according to FIGS. 2 and 3, likewise with the cover and adjusting screw removed, but in the released state.
Figure 3:
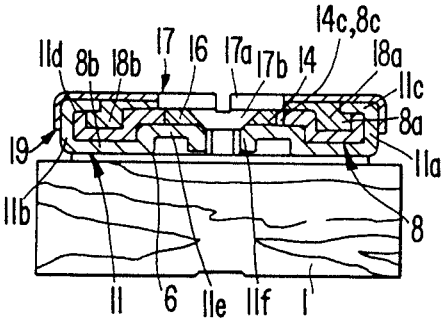
FIG. 3 is a view taken along the line III—III in FIG. 2.
Figure 5:
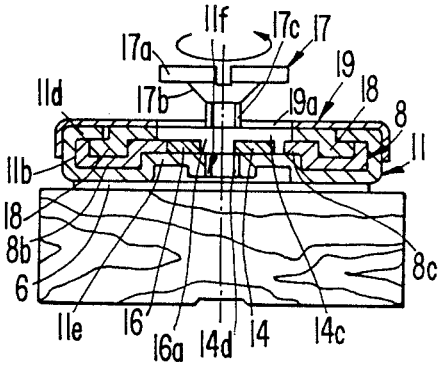
FIG. 5 is a section view taken of the line V—V in FIG. 4.

If the ski binding 1 is to be set to a desired boot size, that is to say the distance between the sold holder 12*b* connected to the slide 11 and belonging to the front jaw 12 and the heel holder 9 fastened to the guide plate 8 is to be changed, the adjusting screw 17 is first unscrewed until the locking teeth 14*c* of the locking member 14 are disengaged from the teeth of the toothed strip 8*c* (see FIG. 4). The slide 11 is then set according to the size of the ski boot to be used.

When the desired position of the slide 11 relative to the guide plate 8 is reached, the adjusting screw 17 is tightened. The cone 17*b* of the screw 17 thereby comes up against the chamfered edges of the V-shaped recesses 14*d* and 16*a* of locking member 14 and supporting plate 16, respectively. Consequently, the locking teeth 14*c* are engaged with the toothed spaces of the toothed strip 8*c*. The result of the this, however, is that the fork prong 8*a* of the guide plate 8 is also pressed against the adjacent leg 11*a* of the slide 11 and retained on this as a result of friction. At the same time, the supporting plate 16 is pressed against the other fork prong 8*b* of the guide plate 8. This fork prong 8*b* is thereby pressed against the leg 11*b* of the slide 11. Thus, the slide 11 is fixed relative to the guide plate 8 not only as a result of the positive connection between the locking teeth 14*c* of the locking member 14 and the toothed strip 8*c*, but also as a result of frictional connection between the supporting plate 16 and the fork prong 8*b* or between the two fork prongs 8*a*, 8*b* and the legs 11*a*, 11*b* of the slide 11.

Figure 6:
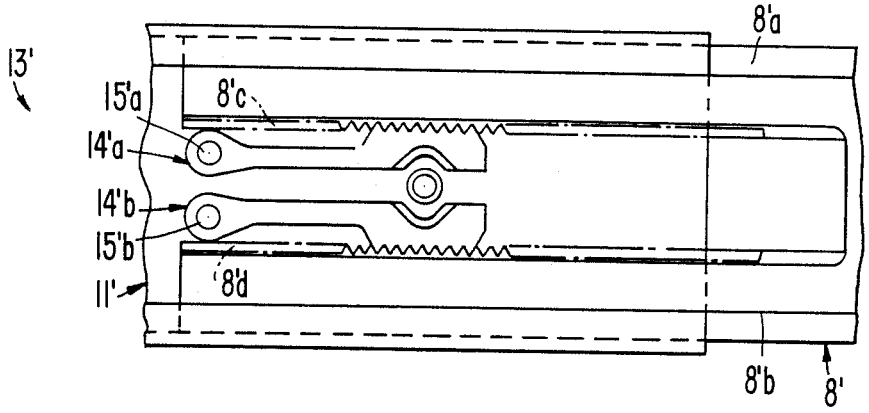
FIGS. 6 and 7 are plan views of a second and third embodiment of the adjusting device according to the present invention, shown in the locked position, the cover and adjusting screw again being removed.
Figure 7:
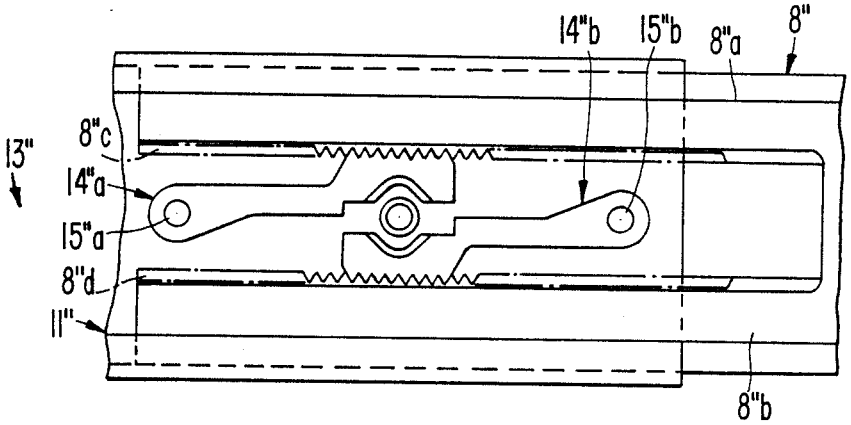
Figure 8:
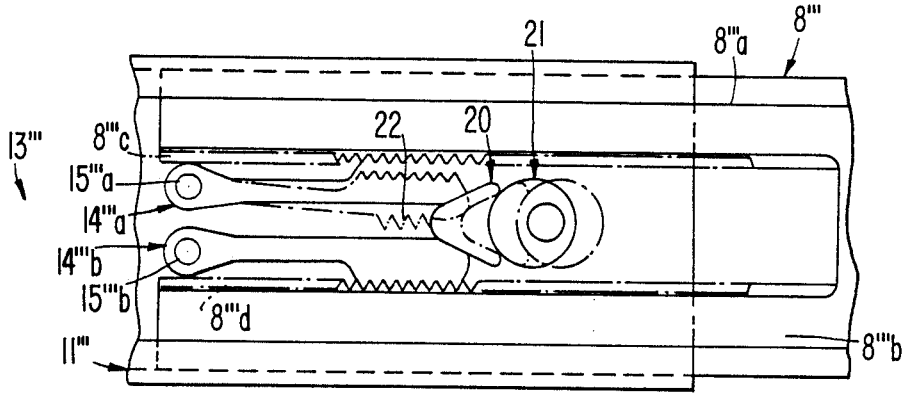
FIG. 8 shows a plan view of a further exemplary embodiment of an adjusting device according to the present invention, once again in the locked position.

The embodiments of adjusting devices 13',13'', 13''', illustrated in FIGS. 6 to 8, differ from that shown in FIGS. 2 to 5 in that, instead of a single locking member, two locking members 14'*a*, 14'*b*; 14''*a*, 14''*b*; 14'''*a*, 14'''*b* and two toothed strips 8'*c*, 8'*d*; 8''*c*, 8''*d*; 8'''*c*, 8'''*d*, respectively, are provided.

In the adjusting device 13' illustrated in FIG. 6, the two locking members 14'*a*, 14'*b* are arranged in a mirror image arrangement in relation to the vertical longitudinal mid-plane, whereas, in the adjusting device 13'' according to FIG. 7, the locking members 14''*a*, 14''*b*, are centrally mounted symmetrically in relation to the axis of the adjusting screw 17''. In FIGS. 6 and 7, 15'*a*, 15'*b* and 15''*a*, 15''*b* designate the pivot axes of the locking members 14'*a*, 14'*b* and 14''*a*, 14''*b* respectively.

The adjusting device 13''' according to FIG. 8 is similar to the design according to FIG. 6 in that the two locking member 14'''*a* and 14'''*b* and their axles 15'''*a* and 15'''*b* are arranged in a mirror-image arrangement in relation to the vertical longitudinal mid-plane. However, here, the adjusting member arranged between the free ends of the two locking members 14'''*a* and 14'''*b* is designed as a wedge 20 which is under the influence of a compression spring 22 and the displacement of which can take place counter to the force of this spring, for example, by means of an eccentric 21 rotatable by hand. The released position of the adjusting device 13''' is represented by dot-and-dash lines.

The invention is not bound to the exemplary embodiments illustrated in the drawings and described above. On the contrary, various modifications of it are possible, without departing from the scope of the invention. For example, the locking member can be biased by a weak-leg spring or the like which lifts the locking member from the associated toothed strip.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An adjustment device for a ski binding comprising:

a slide mounted on a ski, the slide including a plurality of legs and a base extending between the legs;

at least one locking member pivotably mounted on the base on a pivot axis, the locking member including a plurality of teeth;

a guide plate for guiding the slide, the guide plate extending in a longitudinal direction of the ski and comprising a plurality of prongs and at least one strip including a plurality of teeth; and adjustment means for adjusting the slide relative to the guide plate, the adjustment means adapted to be actuated for bringing the teeth of the locking member into engagement with the teeth of the strip and for bringing one of the prongs of the guide plate into frictional engagement with one of the legs of the slide.

2. An adjustment device as claimed in claim 1, further including a movable support plate, wherein the teeth of the locking member are disposed on one side of the base slide and the support plate is disposed on another side of the base.

3. An adjustment device as claimed in claim 1, wherein the at least one locking member comprises two locking members arranged symmetrically with respect to a mid-plane of the vertical axis of the adjustment means.

4. An adjustment device as claimed in claim 1, wherein the at least one locking member comprises two locking members arranged symmetrically with respect to the adjustment means.

5. An adjustment device as claimed in claim 1, wherein the adjustment means comprises an adjustment screw comprising a head and an end opposite the head, the end being screwed into the base, the adjustment screw further comprising a cone provided in the region of the adjustment screw disposed in engagement with the locking member, the cone engaging a plurality of V-shaped recesses formed in the support plate and the at least one locking member.

6. An adjustment device as claimed in claim 1, wherein the adjustment means comprises one of a cam and a double cam.

7. An adjustment device as claimed in claim 1, wherein the adjustment means comprises an eccentric.

8. An adjustment device as claimed in claim 3, wherein the adjusting means comprises a wedge movable between the two locking members for closing the locking members together, the wedge being displaceable in the longitudinal direction of the ski by one of an eccentric and a cam, the eccentric and the cam being biased by a spring for urging the wedge in the direction of the eccentric and the cam.

* * * * *